US007392877B2

(12) United States Patent
Woods, Jr.

(10) Patent No.: US 7,392,877 B2
(45) Date of Patent: Jul. 1, 2008

(54) WATER-SHOOTING ALL-TERRAIN RECREATIONAL VEHICLE

(76) Inventor: Kenneth Michael Woods, Jr., 203 Genung St., Apt. 308, Middletown, NY (US) 10940

( * ) Notice: Subject to any disclaimer, the term of this patent is extended or adjusted under 35 U.S.C. 154(b) by 203 days.

(21) Appl. No.: 11/252,687

(22) Filed: Oct. 17, 2005

(65) Prior Publication Data

US 2006/0082066 A1 Apr. 20, 2006

Related U.S. Application Data

(60) Provisional application No. 60/619,803, filed on Oct. 18, 2004.

(51) Int. Cl.
*B62D 21/00* (2006.01)

(52) U.S. Cl. ..... 180/312; 180/311; 280/781

(58) Field of Classification Search ..... 180/312, 180/311; 280/781
See application file for complete search history.

(56) References Cited

U.S. PATENT DOCUMENTS

| | | | | | |
|---|---|---|---|---|---|
| 2,228,411 | A * | 1/1941 | Sheridan | 180/305 |
| 3,142,200 | A * | 7/1964 | Stillman et al. | 74/551.9 |
| 3,677,446 | A * | 7/1972 | Guyer et al. | 222/610 |
| 4,798,399 | A * | 1/1989 | Cameron | 280/756 |
| 4,807,813 | A * | 2/1989 | Coleman | 239/153 |
| 4,813,706 | A * | 3/1989 | Kincheloe | 280/756 |
| 4,961,395 | A * | 10/1990 | Coast | 440/12.64 |
| 4,973,082 | A * | 11/1990 | Kincheloe | 280/756 |
| 5,174,622 | A * | 12/1992 | Gutta | 296/77.1 |
| 5,203,601 | A * | 4/1993 | Guillot | 296/77.1 |
| 6,543,830 | B1 * | 4/2003 | Stuck | 296/77.1 |
| 6,722,679 | B2 * | 4/2004 | Englert | 280/288.4 |
| 6,749,039 | B1 * | 6/2004 | Uphaus | 180/357 |
| 6,923,627 | B1 * | 8/2005 | Wood et al. | 417/234 |
| 6,945,441 | B2 * | 9/2005 | Gates et al. | 224/401 |
| 2003/0164426 | A1 * | 9/2003 | St. Clair et al. | 244/138 R |
| 2004/0021333 | A1 * | 2/2004 | Hancock | 296/79 |
| 2004/0129489 | A1 * | 7/2004 | Brasseal et al. | 180/350 |
| 2004/0154854 | A1 * | 8/2004 | Stephens | 180/291 |
| 2005/0191187 | A1 * | 9/2005 | Vos et al. | 417/234 |
| 2005/0242133 | A1 * | 11/2005 | Ward | 222/610 |

* cited by examiner

*Primary Examiner*—Anne Marie Boehler
*Assistant Examiner*—Timothy Wilhelm
(74) *Attorney, Agent, or Firm*—Raymond M. Galasso; Galasso & Associates, LP; David O. Simmons

(57) ABSTRACT

An all-terrain recreational vehicle comprises a frame, a seat assembly, a plurality of tire assemblies, a steering assembly, a power delivery assembly, a water reservoir, a nozzle and an actuation mechanism. The frame includes a padded roll cage and the seat assembly is attached to the frame. The plurality of tire assemblies is attached to the frame. The steering assembly is connected between the frame and at least two of the tire assemblies. The power delivery assembly is connected to at least one of the tire assemblies. The water reservoir is attached to the frame and the nozzle is in fluid communication with the water reservoir. The actuation mechanism is attached to the frame at a remote location from the nozzle. The actuation mechanism is operably connected between the nozzle and the water reservoir for enabling selective dispensing of water from the water reservoir through the nozzle.

11 Claims, 3 Drawing Sheets

WATER-SHOOTING ALL-TERRAIN RECREATIONAL VEHICLE

CROSS REFERENCE TO RELATED APPLICATIONS

This patent application claims priority to co-pending U.S. Provisional Patent Application having Ser. No. 60/619,803, filed Aug. 18, 2004 entitled "Hydro-kart", having a common applicant herewith and being incorporated herein in its entirety by reference.

FIELD OF THE DISCLOSURE

The disclosures made herein relate generally to all-terrain recreational vehicles, more particularly, to all-terrain recreational vehicle having one or more water-shooting devices mounted thereon.

BACKGROUND

By very nature, games are played with the intent of accomplishing a specified objective or objectives. In many cases, a game apparatus used to play a game entirely or largely dictates the specified objective of the game. Accordingly, in such cases, it is the game apparatus itself that correspondingly defines the uniqueness, degree of challenge and intent of the game.

It should be noted that a game apparatus is often used or even conceived as a toy (i.e., not related to facilitating game play). Thus, when not being used for facilitating game play, such game apparatuses may be used strictly in a non-game-like manner (e.g., non-competitive and/or entertainment purposes). Such dual-mode use further adds to the utility and enjoyment associated with some game apparatuses.

The horizon for new games is virtually limitless. Because of the breadth of interests of people and their continual desire for new challenges, games and game apparatuses of all types are continually being devised. With rare exception, so long as a game offers a new challenge, there will be an audience, large or small, willing to play it. Therefore, a game apparatus that offers a challenging new objective is useful to such an audience and offers advantageous functionality relative to other game apparatuses with which the audience has played.

SUMMARY OF THE DISCLOSURE

The present invention is embodied by an all terrain vehicle that includes one or more water guns mounted thereon. Preferably, but not necessarily, the all-terrain recreational vehicle is a conventional type of off-road go-kart. The water guns are mounted on the all terrain vehicle in a manner enabling a spray of water to be shot in a direction parallel with a longitudinal centerline axis of the all-terrain recreational vehicle. A remotely located actuation mechanism is connected to the one or more water guns and is configured for enabling selective dispensing of water from the water guns. In doing, so, a person may partake in a ride in the all-terrain recreational vehicle and operate the water guns while driving. The person may drive the all-terrain recreational vehicle and operate the water guns for purely entertainment value or may partake in a game where the person attempts to hit another person or vehicle while driving (e.g., a game of water-tag on all-terrain recreational vehicles).

In one embodiment of the present invention, an all-terrain recreational vehicle comprises a first mounted water gun and an actuation mechanism operably connected to the first mounted water gun. The actuation mechanism is configured for enabling selective dispensing of water from the first mounted water gun. The actuation mechanism is mounted at a remote location with respect to the first mounted water gun.

In another embodiment of the present invention, an all-terrain recreational vehicle comprises a frame, a seat assembly, a plurality of tire assemblies, a steering assembly, a power delivery assembly, a first water gun and an actuation mechanism. The frame includes a padded roll cage and a seat assembly is attached to the frame. The plurality of tire assemblies is rotatably attached to the frame. The steering assembly is connected between the frame and at least two of the tire assemblies. The power delivery assembly is connected to at least one of the tire assemblies. The first water gun is attached at a first location of the frame. The actuation mechanism is attached to the frame. The actuation mechanism is located at a remote location from the first water gun. The actuation mechanism is operably connected to the first water gun for enabling selective dispensing of water from the first water gun.

In another embodiment of the present invention, an all-terrain recreational vehicle comprises a frame, a seat assembly, a plurality of tire assemblies, a steering assembly, a power delivery assembly, a water reservoir, a nozzle and an actuation mechanism. The frame includes a padded roll cage and the seat assembly is attached to the frame. The plurality of tire assemblies is attached to the frame. The steering assembly is connected between the frame and at least two of the tire assemblies. The power delivery assembly is connected to at least one of the tire assemblies. The water reservoir is attached to the frame and the nozzle is in fluid communication with the water reservoir. The actuation mechanism is attached to the frame at a remote location from the nozzle. The actuation mechanism is operably connected between the nozzle and the water reservoir for enabling selective dispensing of water from the water reservoir through the nozzle.

Turning now to specific aspects of the present invention, in at least one embodiment, a second water gun attached at a second location of the frame different than the first location, wherein the actuation mechanism is operably connected to the second water gun for enabling selective dispensing of water from the second water gun.

In at least one embodiment of the present invention, a third water gun attached at a third location of the frame different than the first and second locations, wherein the actuation mechanism is operably connected to the third water gun for enabling selective dispensing of water from the third water gun.

In at least one embodiment of the present invention, the first water gun and the second water gun are mounted on opposing sides of the seating assembly, the seating assembly is approximately centered on a longitudinal centerline axis of the frame, and the third water gun is approximately centered on the longitudinal centerline axis of the frame.

In at least one embodiment of the present invention, each water gun includes a water reservoir portion and a nozzle portion communicatively attached to the water reservoir portion for enabling water to be supplied from the water reservoir portion to the nozzle portion.

In at least one embodiment of the present invention, a spray direction of the nozzle portion of each water gun extends approximately parallel with a longitudinal centerline axis of the frame.

In at least one embodiment of the present invention, the actuation mechanism is fixedly attached to at least one of the frame, steering wheel, and the seat assembly.

In at least one embodiment of the present invention, the actuation mechanism includes a pistol-like handgrip and pistol-like trigger movably attached to the pistol-like handgrip, and movement of the pistol-like trigger from an at rest position to a displaced position controls the selective dispensing of water through each water gun.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
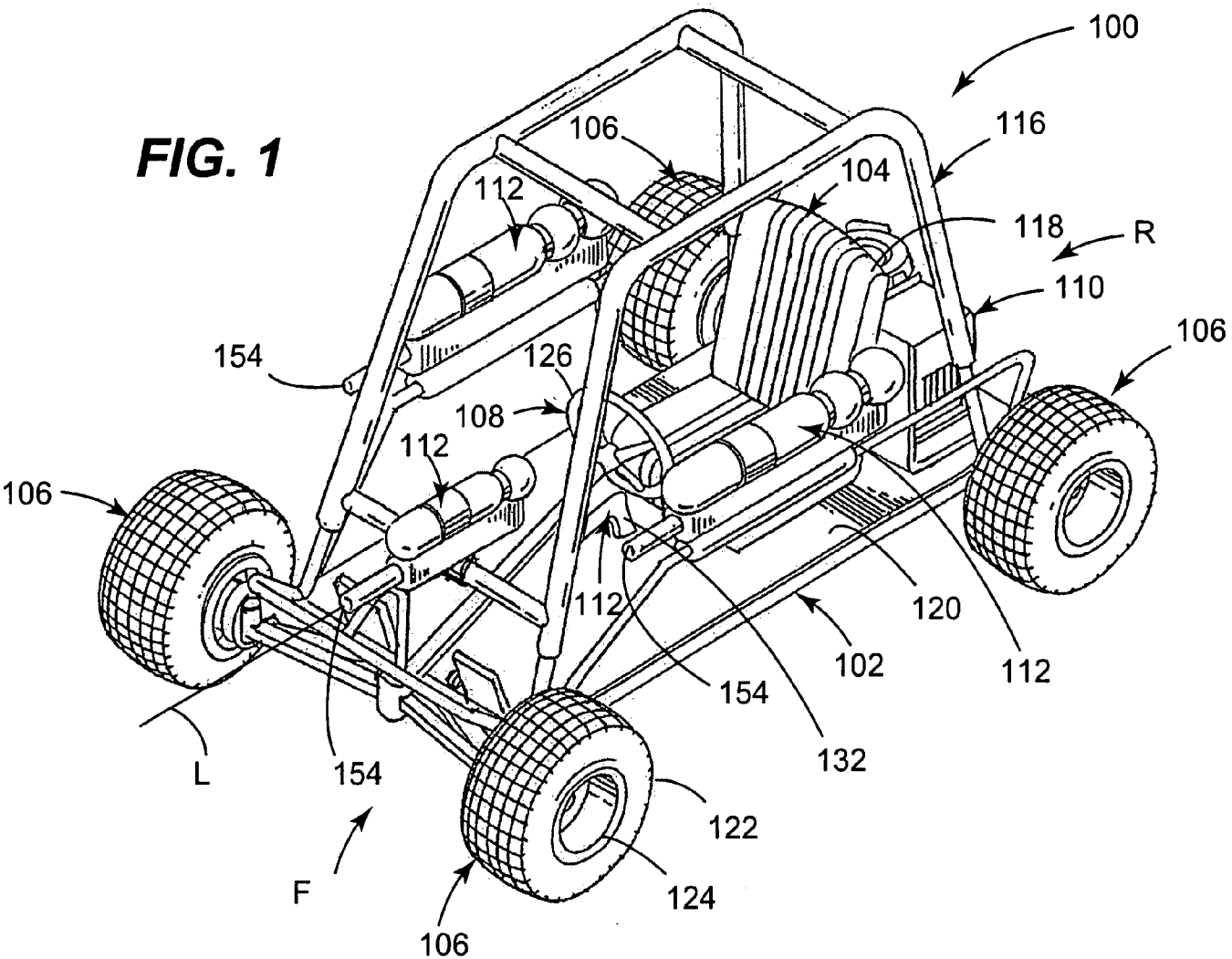
FIG. 1 depicts an embodiment of a water-shooting all-terrain recreational vehicle in accordance with the present invention.
Figure 2:
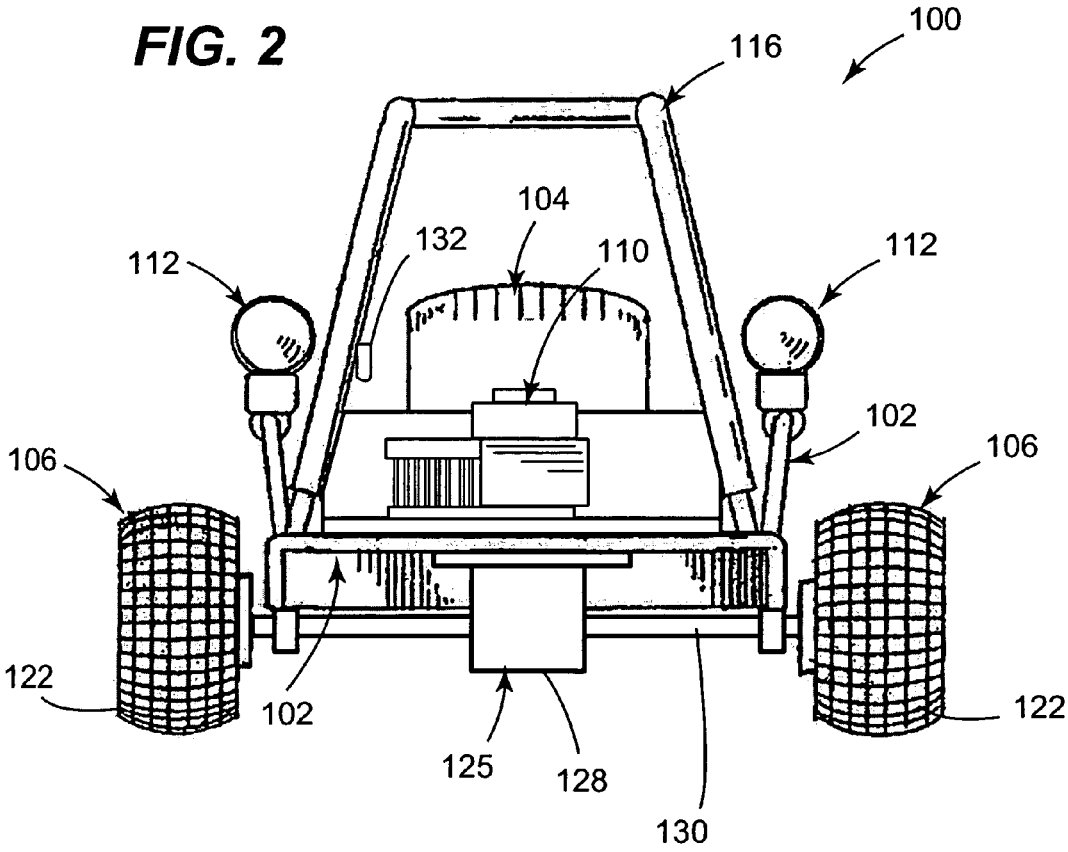
FIG. 2 is rear view of the water-shooting all-terrain recreational vehicle depicted in FIG. 1.

FIGS. 1 and 2 depict an embodiment of an all-terrain recreational vehicle configured with a water shooting system in accordance with the present invention, which is referred to herein as the water-shooting all-terrain recreational vehicle 100. An all-terrain recreational vehicle such as the water-shooting all-terrain recreational vehicle 100 is disclosed herein as a vehicle that is intended for non-highway use and for recreational purposes. A go-kart configured for off-road and on-road recreational use is an example of an all-terrain recreational vehicle in accordance with the present invention. A skilled person will appreciate that the present invention is not limited to a particular type of all-terrain recreational vehicle that is configured for off-road use, on-road use, or both. Known all-terrain recreational vehicles of various types may be adapted with a water shooting system in accordance with the present invention.

The water shooting all-terrain recreational vehicle 100 includes a frame 102, a seat assembly 104, a plurality of tire assemblies 106, a steering assembly 108, an engine 110, a plurality of water guns 112, and an actuation mechanism 114. The frame 102 includes a padded roll cage 116. The seat assembly 108 is attached to the frame 102. The seat assembly 104 includes a seat 118 and mounting means (e.g., bracket (s)) for enabling the seat to be securely mounted to the frame 102 (e.g., a floor pan 120 of the frame 102).

Each one of the tire assemblies 106 includes a tire 122 mounted on a wheel 124. Each tire assembly 106 is attached to the frame 102 through the steering assembly 108 or a rear drivetrain 125 (FIG. 2). The steering assembly 108 is connected between the frame 102 and the two tire assemblies 106 at a front end F of the water-shooting all-terrain recreational vehicle 100. The steering assembly 108 includes a steering wheel 126 connected to related steering components (e.g., steering shaft, tie rods and spindles). The steering system 108 enables the tire assemblies 106 at the front end F of the water-shooting all-terrain recreational vehicle 100 to be steered for controlling a travel direction of the water shooting all-terrain recreational vehicle 100. The present invention is not limited to a particular type of steering assembly.

As depicted in FIG. 2, the engine 110 is connected to at least one of the tire assemblies 106 at a rear end R of the water shooting all-terrain recreational vehicle 100 through a gearbox 128 and axle 130 of the rear drivetrain 125. Jointly, the engine 110 and rear drivetrain 125 depict an embodiment of a power delivery assembly in accordance with the present invention. Other embodiments of suitable power delivery assemblies in accordance with the present invention include, but are not limited to, a battery-powered electric motor with gearbox, a pedal-type drivetrain and the like. The present invention is not limited to a particular type of power delivery assembly.

The water guns 112 are each mounted on the frame 102 at different locations from each other. A first one of the water guns 112 and a second one of the water guns 112 are mounted on the frame 102 on opposing sides of the seating assembly 104. The seating assembly 104 is approximately centered on a longitudinal centerline axis L (i.e., a reference axis) of the frame. A third one of the water guns 112 is approximately centered on the longitudinal centerline axis L of the frame.

The actuation mechanism 114 is operably connected to each of the water guns 112 for enabling selective dispensing of water from the water guns 112. As depicted, a control portion 132 the actuation mechanism 114 is fixedly attached to the frame 102 at a remote location from the water guns 112. Preferably, but not necessarily, the control portion 132 of the actuation mechanism 114 is readily accessible from a seated position on the seat 118 of the seating assembly 104. A location near the steering wheel 126 is a preferred location for the control portion 132 of the actuation mechanism 114.

Figure 3:
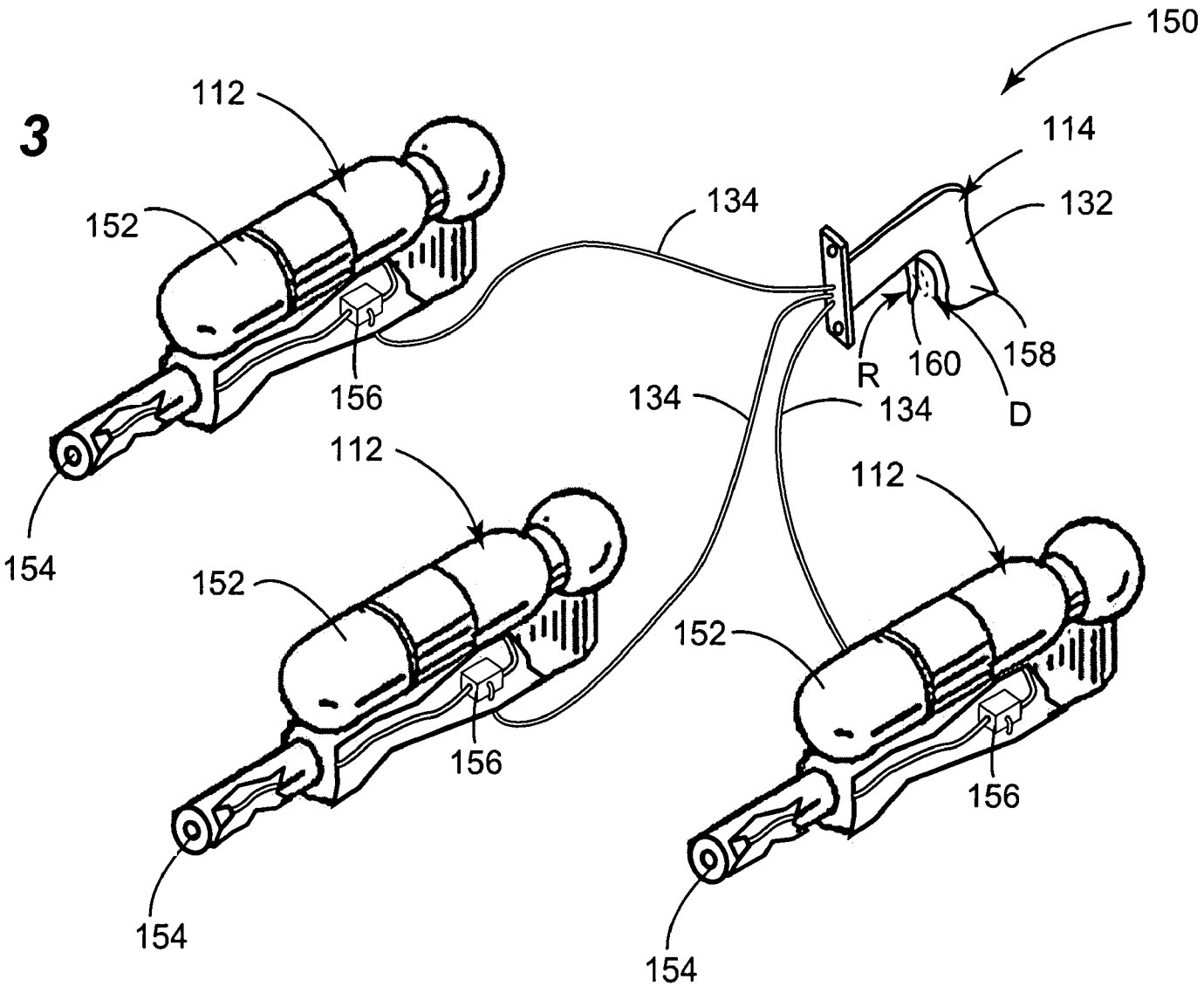
FIG. 3 depicts an embodiment of a water shooting system in accordance with the present invention.

Referring now to FIGS. 1 and 3, a water shooting system 150 in accordance with the present invention comprises the water guns 112 and the actuation mechanism 114. Each one of the water guns 112 includes a water reservoir portion 152, a nozzle portion 154 and a control valve portion 156. Preferably, but not necessarily, a spray direction of the nozzle portion 154 of each nozzle portion 154 extends approximately parallel with the longitudinal centerline axis L of the frame 102. Each nozzle portion 154 is communicatively attached to a respective water reservoir portion 152 via a respective control valve portion 156. Each control valve portion 156 is configured for enabling water to be selectively supplied from the respective water reservoir portion 152 to the respective nozzle portion 154. Flow tubes are connects from each control valve portion 156 to the respective water reservoir portion 152 and the respective nozzle portion 154. Pressure for enabling the water to be dispensed through the nozzle portion 154 may be provided by means such as, for example, pressurization of the water reservoir portion 152, an electric pump for receiving water from the water reservoir portion 152 and pressurizing such water (e.g., a pump integral with the control valve portion 156), or other suitable water pressurization means.

The actuation mechanism 114 includes the control portion 132 and a plurality of interconnect members 134. A twisted wire cable in a sheath, a hydraulic line, a pneumatic line and a pair of electrical wires are each examples of interconnect members useful in accordance with the present invention. Each one of the interconnect members 134 is connected between the control portion 132 of the actuation mechanism 114 and the control valve portion 156 of a respective one of the water guns 112. In the depicted embodiment, the control portion 132 of the actuation mechanism 114 includes a pistol-like handgrip 158 and pistol-like trigger 160 movably attached to the pistol-like handgrip. Movement of the pistol-like trigger 160 from an at rest position R to a displaced position D causes a corresponding actuation action (e.g., a force, an electrical current, etc) on the control valve portion 156 of each one of the water guns 112 via a respective one of the interconnect members 134. Through such corresponding actuation action, selective dispensing of water from each water gun 112 is facilitated.

Although not specifically depicted, it is disclosed herein that a separate actuation mechanism could be provided for each one of the water guns or for at least two different water guns. For example, a separate control portion and interconnect member could be connected to each one of the water guns 112 depicted in FIGS. 1 and 3.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A water-shooting all-terrain recreational vehicle, comprising:

a frame including a padded roll cage;

a seat assembly attached to the frame;

a plurality of tire assemblies attached to the frame;

a steering assembly connected between the frame and at least two of said tire assemblies;

a power delivery assembly connected to at least one of said tire assemblies;

a first water gun attached at a first location of the frame; and an actuation mechanism attached to the frame, wherein the actuation mechanism is located at a remote location from the first water gun, wherein the actuation mechanism is operably connected to the first water gun for enabling selective dispensing of water from the first water gun; said actuation mechanism includes a grip shaped like the butt of a pistol and a trigger movably attached to the grip;

wherein movement of the trigger from an at rest position to a displaced position controls said selective dispensing of water.

2. The water-shooting all-terrain recreational vehicle of claim 1, further comprising:

a second water gun attached at a second location of the frame different than the first location, wherein the actuation mechanism is operably connected to the second water gun for enabling selective dispensing of water from the second water gun.

3. The water-shooting all-terrain recreational vehicle of claim 1, further comprising:

a third water gun attached at a third location of the frame different than said first and second locations, wherein the actuation mechanism is operably connected to the third water gun for enabling selective dispensing of water from the third water gun.

4. The water-shooting all-terrain recreational vehicle of claim 3 wherein:

the first water gun and second water gun are mounted on opposing sides of the seating assembly;

the seating assembly is approximately centered on a longitudinal centerline axis of the frame; and the third water gun is mounted approximately on the longitudinal centerline axis of the frame.

5. The water-shooting all-terrain recreational vehicle of claim 1 wherein the first water gun includes a water reservoir portion and a nozzle portion communicatively attached to the water reservoir portion for enabling water to be supplied from the water reservoir portion to the nozzle portion.

6. The water-shooting all-terrain recreational vehicle of claim 5 wherein a spray direction of the nozzle portion extends approximately parallel with a longitudinal centerline axis of the frame.

7. The water-shooting all-terrain recreational vehicle of claim 1 wherein the actuation mechanism is fixededly attached.

8. The water-shooting all-terrain recreational vehicle of claim 1 further comprising:

a second water gun attached at a second location of the frame different than the first location; and a third water gun attached at a third location of the frame different than said first and second locations;

wherein the actuation mechanism is operably connected to said second and third water guns for enabling selective dispensing of water from said second and third water guns;

wherein the first water gun and the second water gun are mounted on opposing sides of the seating assembly;

wherein the seating assembly is approximately centered on a longitudinal centerline axis of the frame;

wherein the third water gun is mounted approximately on the longitudinal centerline axis of the frame;

wherein each one of said water guns include a respective water reservoir portion and a respective nozzle portion communicatively attached to the respective water reservoir portion for enabling water to be supplied from the respective water reservoir portion to the respective nozzle portion; and wherein a spray direction of the respective nozzle portion of each one of said water guns extends approximately parallel with a longitudinal centerline axis of the frame.

9. A water-shooting all-terrain recreational vehicle, comprising:

a frame including a padded roll cage;

a seat assembly attached to the frame;

a plurality of tire assemblies attached to the frame;

a steering assembly connected between the frame and at least two of said tire assemblies;

a power delivery assembly connected to at least one of said tire assemblies;

a water reservoir attached to the frame;

a nozzle attached to the water reservoir; and an actuation mechanism attached to the frame at a remote location from the nozzle, wherein the actuation mechanism is operably connected between the nozzle and the water reservoir for enabling selective dispensing of water from the water reservoir through the nozzle; said actuation mechanism includes a grip shames like the butt of a pistol and a trigger movably attached to the grip; wherein movement of the trigger from an at rest position to a displaced position controls said selective dispensing of water.

10. The water-shooting all-terrain recreational vehicle of claim 9 wherein a spray direction of the nozzle extends approximately parallel with a longitudinal centerline axis of the frame.

11. The water-shooting all-terrain recreational vehicle of claim 9 wherein a spray direction of the nozzle portion extends approximately parallel with a longitudinal centerline axis of the frame.

* * * * *